US011737618B1

(12) United States Patent
Georgas

(10) Patent No.: US 11,737,618 B1
(45) Date of Patent: Aug. 29, 2023

(54) FLUSHABLE SPLASH SHEETS

(71) Applicant: Richard Georgas, Tonopah, AZ (US)

(72) Inventor: Richard Georgas, Tonopah, AZ (US)

( * ) Notice: Subject to any disclaimer, the term of this patent is extended or adjusted under 35 U.S.C. 154(b) by 22 days.

(21) Appl. No.: 17/533,187

(22) Filed: Nov. 23, 2021

(51) Int. Cl.
*A47K 11/10* (2006.01)
*A47K 13/16* (2006.01)

(52) U.S. Cl.
CPC ..... *A47K 11/105* (2013.01); *A47K 13/16* (2013.01)

(58) Field of Classification Search
CPC ..... A47K 11/105
USPC ..... 4/300.3, 301, 415
See application file for complete search history.

(56) References Cited

U.S. PATENT DOCUMENTS

D341,414 S 11/1993 Baker
5,403,299 A * 4/1995 Schneider ..... A61F 5/445 604/361
5,953,764 A * 9/1999 Lin ..... A47K 11/105 4/245.4
6,061,841 A * 5/2000 Parviainen ..... A47K 11/105 4/245.8
8,112,828 B1 * 2/2012 Varela, III ..... A61L 2/22 4/300.3
9,487,939 B1 * 11/2016 Cook ..... E03D 9/022
10,280,601 B1 * 5/2019 Perez ..... E03C 1/22
D877,301 S * 3/2020 Stewart ..... D6/583
2006/0123530 A1 * 6/2006 Smith ..... A47K 13/16 4/245.5
2009/0113613 A1 5/2009 Kole
2009/0158514 A1 * 6/2009 Doctors ..... A47K 11/105 4/300.3
2011/0067171 A1 * 3/2011 Kouadio ..... A47K 13/14 4/245.1
2014/0087339 A1 * 3/2014 Ventle ..... G09B 19/0076 434/236
2016/0302630 A1 * 10/2016 Campbell ..... A47K 11/105
2017/0058501 A1 * 3/2017 Painter ..... E03D 9/007

FOREIGN PATENT DOCUMENTS

GB 2538238 A * 11/2016 ..... A46B 9/005
JP 2006075575 A * 3/2006
WO 2009061844 5/2009

* cited by examiner

*Primary Examiner* — Lori L Baker
(74) *Attorney, Agent, or Firm* — Kyle A. Fletcher, Esq.

(57) ABSTRACT

The flushable splash sheets incorporates a sheeting structure and a toilet. The toilet further incorporates a toilet bowl. The toilet forms a port into the DWV of a domestic plumbing system. The sheeting structure is a degradable structure. By degradable structure is meant that the sheeting structure degrades when placed within the DWV environment. The sheeting structure mounts within the bowl of the toilet. The sheeting structure prevents an excretion flow from splashing out of the toilet bowl. The sheeting structure prevents the splashing of the excretion flow by redirecting portions of the excretion flow in random directions. The sheeting structure is flushed into the DWV for disposal.

13 Claims, 6 Drawing Sheets

FLUSHABLE SPLASH SHEETS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of disposable covers for a toilet bowl.

SUMMARY OF INVENTION

The flushable splash sheets comprises a sheeting structure and a toilet. The toilet further comprises a toilet bowl. The toilet forms a port into the DWV of a domestic plumbing system. The sheeting structure is a degradable structure. By degradable structure is meant that the sheeting structure degrades when placed within the DWV environment. The sheeting structure mounts within the bowl of the toilet. The sheeting structure prevents an excretion flow from splashing out of the toilet bowl. The sheeting structure prevents the splashing of the excretion flow by redirecting portions of the excretion flow in random directions. The sheeting structure is flushed into the DWV for disposal.

These together with additional objects, features and advantages of the flushable splash sheets will be readily apparent to those of ordinary skill in the art upon reading the following detailed description of the presently preferred, but nonetheless illustrative, embodiments when taken in conjunction with the accompanying drawings.

In this respect, before explaining the current embodiments of the flushable splash sheets in detail, it is to be understood that the flushable splash sheets is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flushable splash sheets.

It is therefore important that the claims be regarded as including such equivalent construction insofar as they do not depart from the spirit and scope of the flushable splash sheets. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
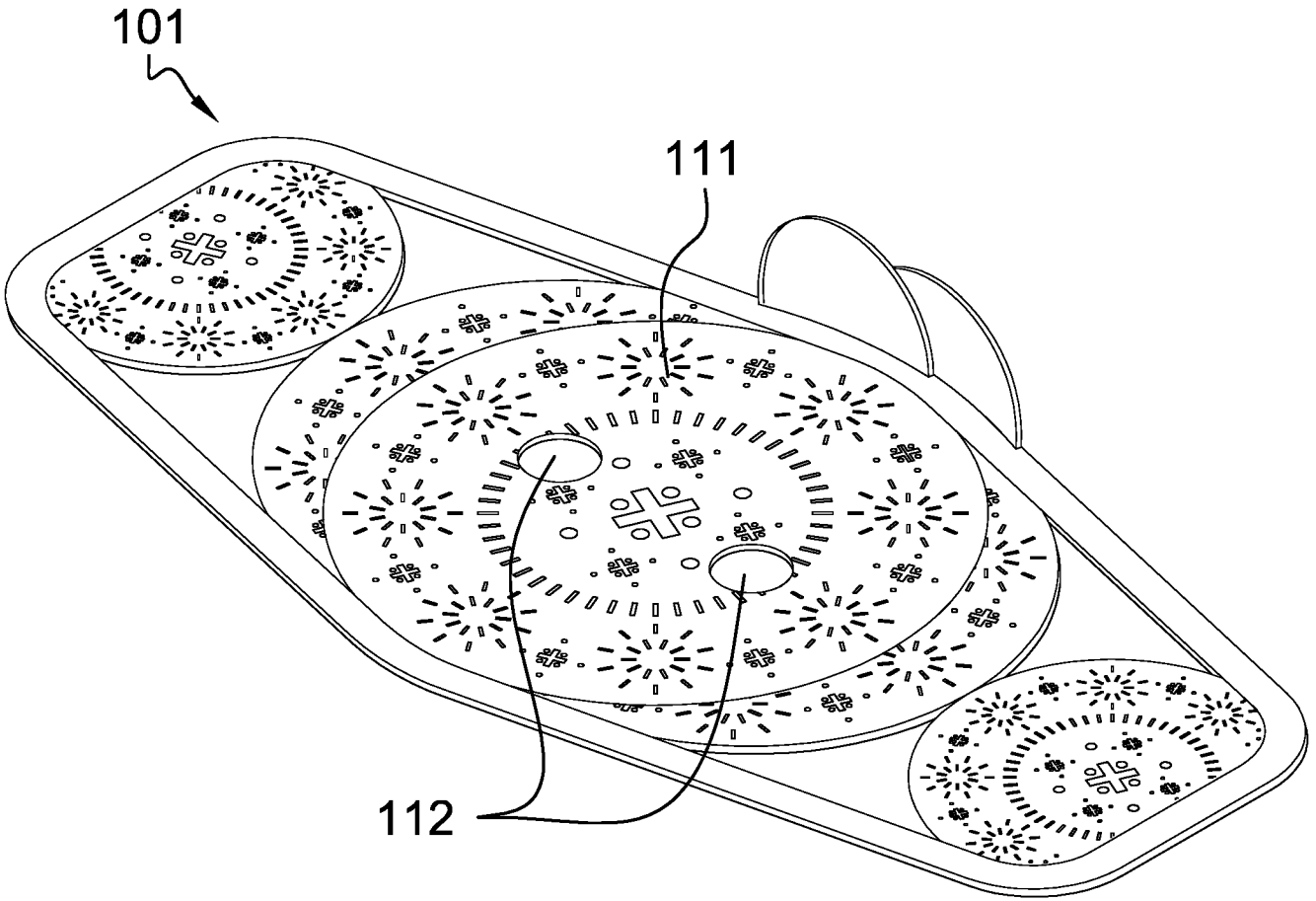
FIG. 1 is a perspective view of an embodiment of the disclosure.
Figure 2:
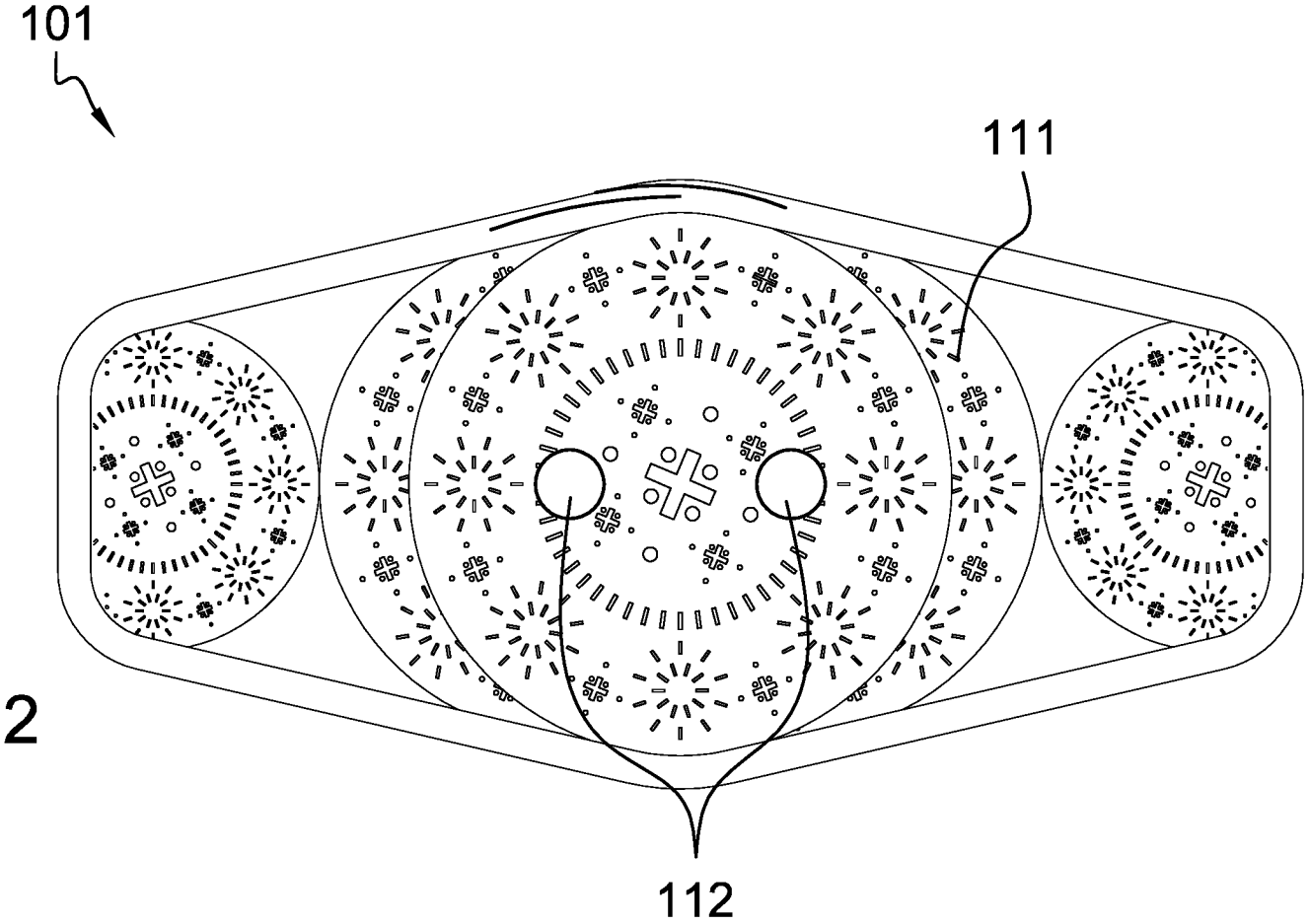
FIG. 2 is a top view of an embodiment of the disclosure.
Figure 3:
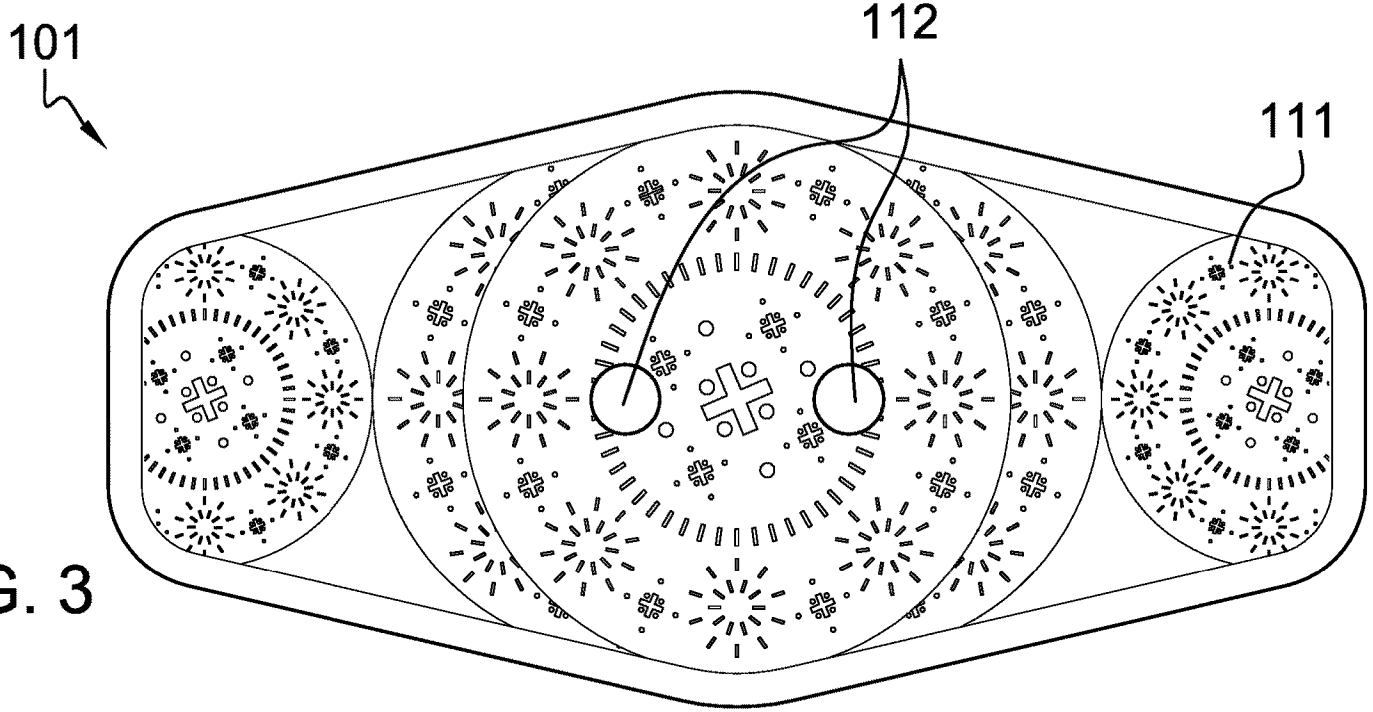
FIG. 3 is a bottom view of an embodiment of the disclosure.
Figure 4:
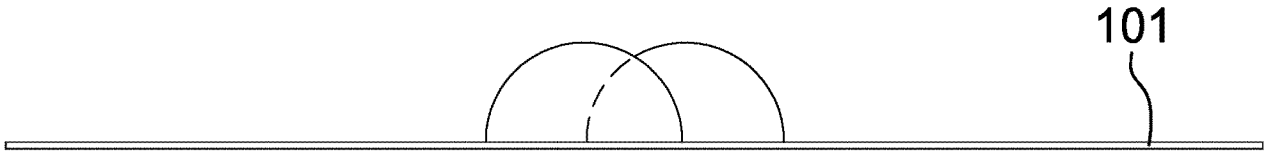
FIG. 4 is a side view of an embodiment of the disclosure.
Figure 5:
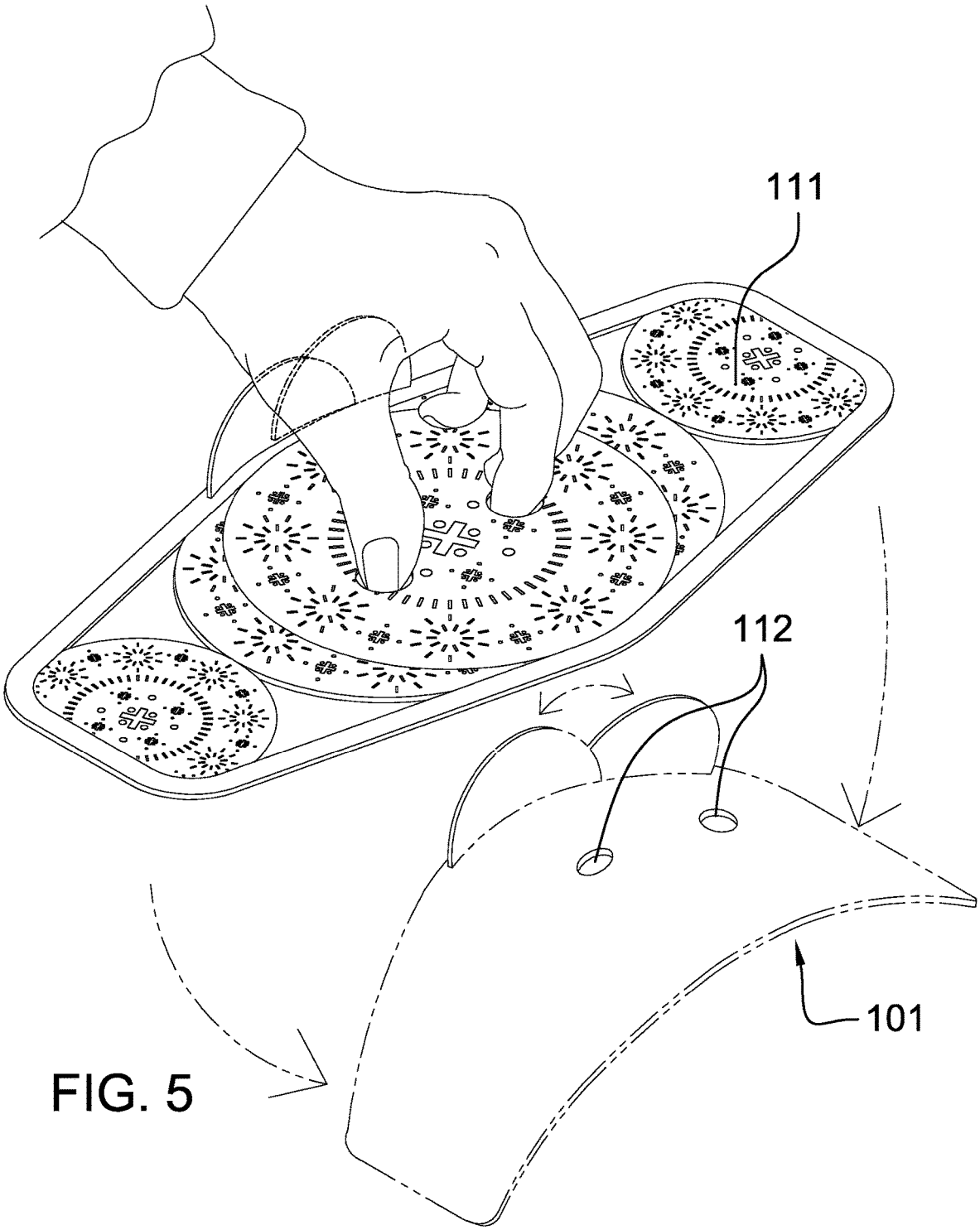
FIG. 5 is an in-use view of an embodiment of the disclosure.
Figure 6:
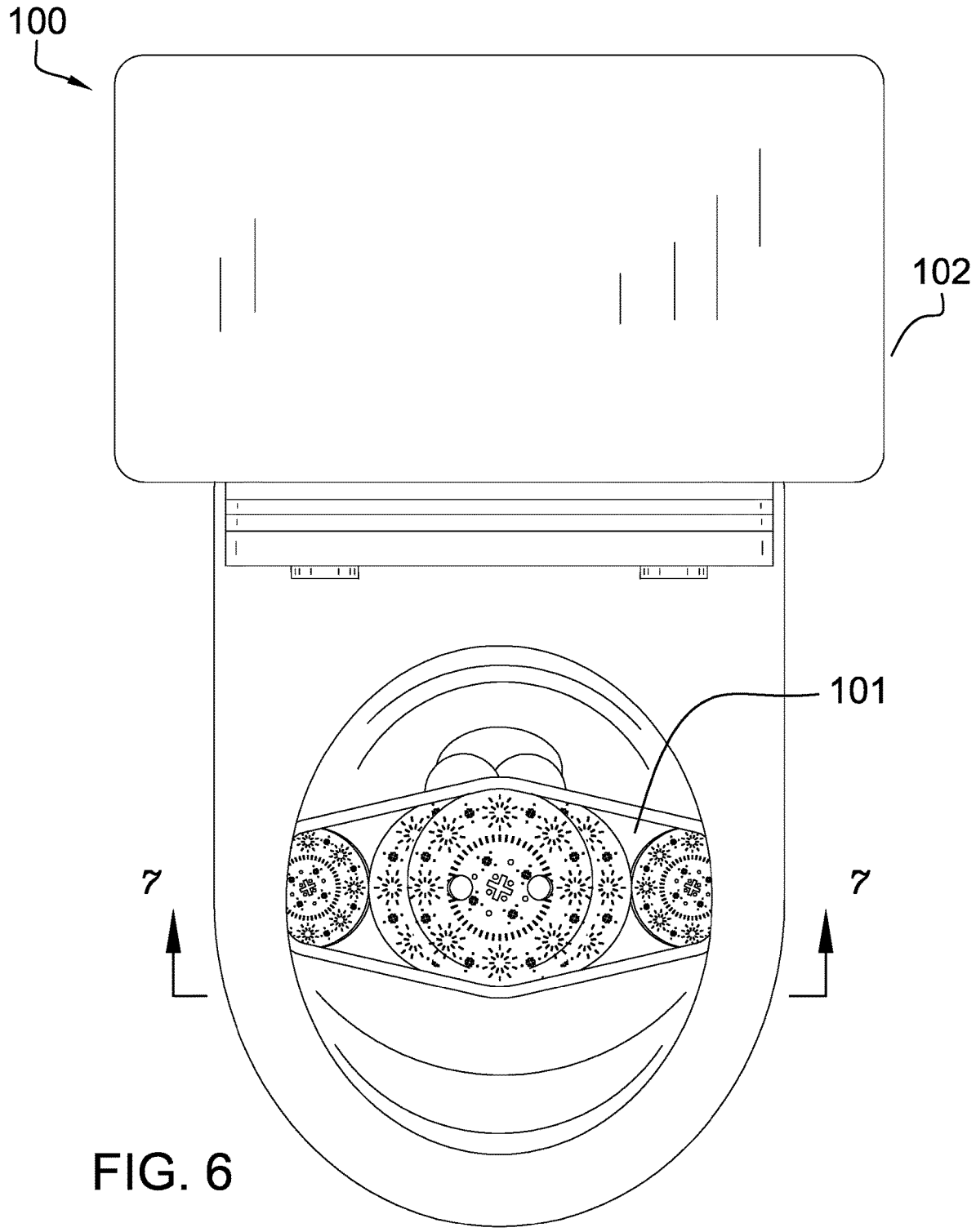
FIG. 6 is an in-use view of an embodiment of the disclosure.
Figure 7:
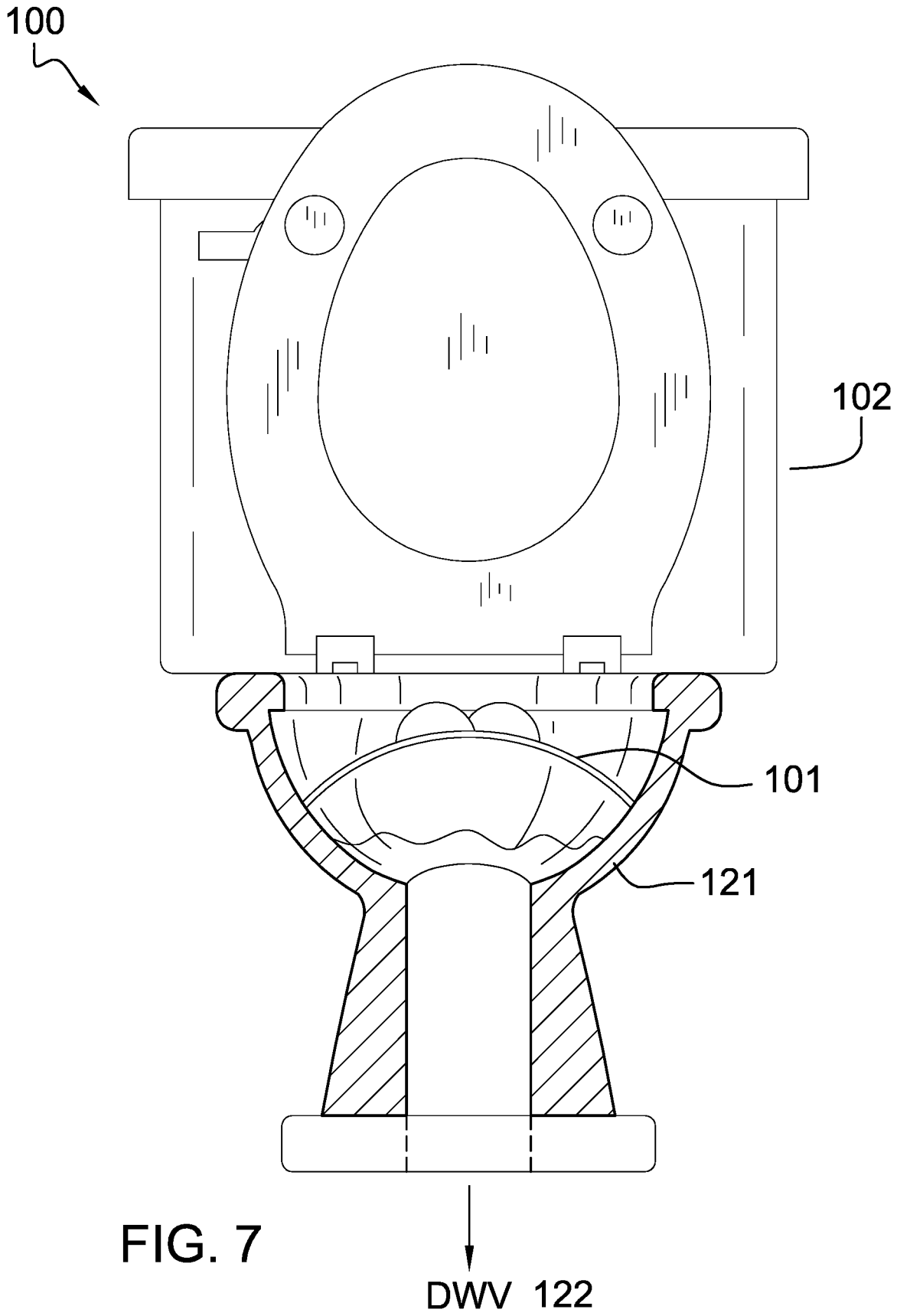
FIG. 7 is a cross-sectional view of an embodiment of the disclosure.

Detailed reference will now be made to one or more potential embodiments of the disclosure, which are illustrated in FIGS. 1 through 7.

The flushable splash sheets 100 (hereinafter invention) comprises a sheeting structure 101 and a toilet 102. The toilet 102 further comprises a toilet 102 bowl 121. The toilet 102 connects to a DWV (Drainage, Waste, Vent) 122 of a domestic plumbing system. The sheeting structure 101 is a degradable structure. By degradable structure is meant that the sheeting structure 101 degrades when placed within the DWV 122 environment. The sheeting structure 101 mounts within the bowl 121 of the toilet 102. The sheeting structure 101 prevents an excretion flow from reflecting out of the toilet 102 bowl 121. The sheeting structure 101 prevents the reflection of the excretion flow by redirecting portions of the excretion flow in random directions. The sheeting structure 101 is flushed into the DWV 122 for disposal.

The toilet 102 is a port associated with a domestic plumbing system. The toilet 102 further comprises a toilet 102 bowl 121 and a DWV 122. The toilet 102 receives biological eliminations and biological excretions. The toilet 102 transports the received biological eliminations and biological excretions to the DWV 122 (Drain Waste Vent System) of a domestic plumbing system. The toilet 102 transports the sheeting structure 101 directly into the DWV 122 after it has been used.

The toilet 102 bowl 121 is the structure of the toilet 102 that physically receives the biological eliminations and biological excretions that are subsequently transported to the DWV 122. The DWV 122 forms the fluidic connections and flow paths of a domestic plumbing system that receives waste water. The DWV 122 forms the fluidic connections and flow paths of the domestic plumbing system that further transports the received waste water to an appropriate disposal facility.

The sheeting structure 101 is a sheeting. The sheeting structure 101 is an elastic flexible structure. By elastic flexible structure is meant that the sheeting structure 101: a) is deformed by an application of a displacing force; and, b) will return to its relaxed shape when the displacing force is removed from the sheeting structure 101. The sheeting structure 101 is a disposable product. The sheeting structure 101 is intended for a single use. The sheeting structure 101 inserts into the toilet 102 bowl 121 under a displacing force such that the sheeting structure 101 forms a non-Euclidean disk structure while in the toilet 102 bowl 121.

The sheeting structure 101 is positioned such that the toilet 102 bowl 121 randomly deflects a liquid based stream of biological excretion that is deposited into the toilet 102 bowl 121. The deflection of the liquid based stream of biological excretion by the sheeting structure 101 prevents the liquid based stream of biological excretion from reflecting out of the toilet 102 bowl 121 during the excretion process. The sheeting structure 101 is formed from a degradable material. Specifically, the sheeting structure 101 is formed from a material that will degrade when exposed to the environment of the DWV 122 of the domestic plumbing system. The sheeting structure 101 is a flushable structure that is flushed through the toilet 102 into the DWV 122 at the end of the elimination process.

The sheeting structure 101 further comprises a foraminous pattern 111 and a plurality of finger holes 112.

The foraminous pattern 111 is a series of negative spaces that are formed through the faces of the disk structure of the sheeting structure 101. The purpose of the foraminous pattern 111 is to deflect the flow of the liquid based stream of biological excretion into a plurality of smaller randomly directed streams as the liquid based stream of biological excretion passes through the foraminous pattern 111. The deflection of the liquid based stream of biological excretion through the foraminous pattern 111 reduces the risk that the liquid based stream of biological excretion will reflect out of the toilet 102 bowl 121. The sheeting structure 101 further forms a barrier that helps to contain the liquid based stream of biological excretion to remain between the sheeting structure 101 and the toilet 102 bowl 121 after the liquid based stream of biological excretion has passed through the sheeting structure 101.

Each of the plurality of finger holes 112 is an aperture that is formed within the foraminous pattern 111. Each of the plurality of finger holes 112 is sized to receive the finger of a hand. The plurality of finger holes 112 forms a grip that allows a user to pick up the sheeting structure 101 using the plurality of finger holes 112. The grip formed by the plurality of finger holes 112 further allows a user to apply a displacement force to the sheeting structure 101 such that the sheeting structure 101 is deformed into a non-Euclidean disk structure.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Biodegradable, Degradable, and Photodegradable: As used in this disclosure, a material is degradable if the chemical composition of the material undergoes decomposition under the conditions of normal temperature and pressure. A material is biodegradable if the chemical composition of the material undergoes decomposition by the action of microorganisms. A material is photodegradable if the chemical composition of the material undergoes decomposition when exposed to light. In the vernacular, the use of the term biodegradable often includes degradable and photodegradable materials.

Decomposition: As used in this disclosure, decomposition refers a chemical process comprising the separation of a molecule of a given atomic mass into two or more molecules or elements, each of lesser atomic mass than the original molecule. Unless stated otherwise in this disclosure, this definition excludes the radioactive processes such as radioactive decay.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Disposable: As used in this disclosure, disposable is an adjective that refers to an object that is designed and intended for a single use. Within this context, an object would be considered disposable if it is not reusable after its initial use.

Domestic Plumbing System: As used in this disclosure, a domestic plumbing system refers to a fluidic network that is formed within a building. The domestic plumbing system transports water received from a utility through the building. Specifically, the domestic plumbing system: a) receives fresh water from the utility and distributes the fresh water through the building; and, b) transports gray water generated within the building and returns the gray water back to the utility for disposal. The domestic plumbing system comprises a supply side and a DWV. Use Supply Side DWV and Utility.

DWV: As used in this disclosure, DWV is an acronym for drainage, waste, and vent. With a domestic plumbing system, DWV refers to the plumbing subnetwork that transports waste water out of the residence to an appropriate waste water handling system. See Supply Side. Use Domestic Plumbing System and Supply Side Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elimination: As used in this disclosure, an elimination refers to a solid phase discharge from a biological entity.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Excretion: As used in this disclosure, an excretion refers to a liquid phase discharge from a biological entity.

Flexible: As used in this disclosure, flexible refers to an object or material that will deform when a force is applied to it but that will not necessarily return to its original shape when the deforming force is removed.

Flushable: As used in this disclosure, the term flushable refers to an object that will degrade when placed within a DWV environment. The flushable implies that the object can be disposed of through a toilet.

Foraminous: As used in this disclosure, foraminous is an adjective that describes a surface, plate, or platform that is perforated with a plurality of apertures.

Form Factor: As used in this disclosure, the term form factor refers to the size and shape of an object.

Modulus: As used in this disclosure, the modulus of an elastic textile or elastic sheeting is a function that describes the percentage change in the span of the elastic textile or elastic sheeting as a function of the force applied to the elastic textile or elastic sheeting. When comparing modulus, a larger modulus is taken to imply that an increase in force is required to get the same percentage change in the elastic textile or elastic sheeting.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Supply Side: As used in this disclosure, the supply side refers to the plumbing subnetwork within a domestic plumbing system that provisions fresh water for use within the residence. See DWV.

Toilet: As used in this disclosure, a toilet is a port into which biological excretions and eliminations are deposited in preparation of introducing the excretions and eliminations into an externally provided waste water handling system. A typical toilet comprises a bowl, a flush mechanism and a refill mechanism. The bowl forms a structure used to receive and contain the excretions and eliminations. The flush mechanism releases a flow of water that transports the deposited excretions and eliminations into the DWV of a plumbing system. The refill mechanism replenishes the water used by the flush mechanism in anticipation of future use of the toilet. A toilet often further comprises a toilet seat and a toilet lid. The toilet seat allows an individual to sit while depositing excretions and eliminations. The toilet lid encloses the bowl of the toilet.

Vernacular: As used in this disclosure, vernacular is a noun that refers to the common meaning and usage of a word as opposed to a specialized or more specific meaning and usage of the same word by a person skilled in an art.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A flushable splash sheet comprising
a sheeting structure and a toilet;
wherein the toilet connects to a DWV (Drainage, Waste, Vent) of a domestic plumbing system;
wherein the toilet further comprises a bowl;
wherein the sheeting structure mounts within the bowl of the toilet;
wherein the sheeting structure further comprises a foraminous pattern and a plurality of finger holes;
wherein each of the plurality of finger holes is an aperture that is formed within the foraminous pattern.

2. The flushable splash sheet according to claim 1
wherein the sheeting structure is degradable;
wherein the sheeting structure degrades when placed within the DWV environment.

3. The flushable splash sheet according to claim 2
wherein the sheeting structure prevents a biological excretion flow from splashing out of the toilet bowl;
wherein the sheeting structure redirects portions of the biological excretion flow in random directions.

4. The flushable splash sheet according to claim 3 wherein the sheeting structure is flushed into the DWV for disposal.

5. The flushable splash sheet according to claim 4
wherein the sheeting structure is a sheeting;
wherein the sheeting structure is an elastic flexible structure;
wherein the elastic flexible sheeting structure: a) is deformed by an application of a displacing force; and, b) will return to its relaxed shape when the displacing force is removed from the sheeting structure.

6. The flushable splash sheet according to claim 5
wherein the sheeting structure is a disposable product;
wherein the sheeting structure is intended for a single use.

7. The flushable splash sheet according to claim 6 wherein the sheeting structure inserts into the toilet bowl such that the sheeting structure forms a non-Euclidean disk structure while in the toilet bowl.

8. The flushable splash sheet according to claim 7 wherein the sheeting structure is positioned such that the toilet bowl randomly deflects a liquid based stream of biological excretion that is deposited into the toilet bowl.

9. The flushable splash sheet according to claim 8 wherein the sheeting structure is formed from a degradable material.

10. The flushable splash sheet according to claim 9 wherein the sheeting structure is a flushable structure that is flushed through the toilet into the DWV.

11. The flushable splash sheet according to claim 10
wherein the foraminous pattern is a series of negative spaces that are formed through the faces of the disk structure of the sheeting structure;
wherein the foraminous pattern deflects the flow of the liquid based stream of biological excretion into a plurality of smaller randomly directed streams as the liquid based stream of biological excretion passes through the foraminous pattern.

12. The flushable splash sheet according to claim 11
wherein each of the plurality of finger holes is sized to receive the finger of a hand;
wherein the plurality of finger holes forms a grip used to pick up the sheeting structure.

13. The flushable splash sheet according to claim 12 wherein the grip applies a displacement force to the sheeting structure such that the sheeting structure is deformed into a non-Euclidean disk structure.

* * * * *